US005347820A

United States Patent [19]

In Gweon

[11] Patent Number: 5,347,820

[45] Date of Patent: Sep. 20, 1994

[54] MOUNTING ARRANGEMENT FOR A REFRIGERATOR DEODORIZER

[75] Inventor: Kang In Gweon, Seoul, Rep. of Korea

[73] Assignee: Samsung Electronics Co., Ltd., Suwon City, Rep. of Korea

[21] Appl. No.: 103,664

[22] Filed: Aug. 10, 1993

[51] Int. Cl.[5] ..... F24F 3/16; A62B 7/08; F25D 23/00

[52] U.S. Cl. ..... 62/78; 62/275; 62/276; 422/122

[58] Field of Search ..... 62/78, 276, 275, 443; 422/122; 219/201; 165/181

[56] References Cited

U.S. PATENT DOCUMENTS

| | | | |
|---|---|---|---|
| 3,320,761 | 5/1967 | Gelbard | 62/443 X |
| 4,223,538 | 9/1980 | Braden et al. | 62/443 |
| 4,229,945 | 10/1980 | Griffin et al. | 62/443 X |
| 4,492,851 | 1/1985 | Carr | 62/276 X |
| 4,509,335 | 4/1985 | Griffin et al. | 62/443 X |
| 4,527,624 | 7/1985 | Nishida et al. | 62/275 X |
| 4,766,736 | 8/1988 | Waldschmidt | 62/275 |
| 4,948,567 | 8/1990 | Atarashiya | 422/122 |

FOREIGN PATENT DOCUMENTS

| | | | |
|---|---|---|---|
| 2233978 | 9/1990 | Japan | 62/78 |
| 2254280 | 10/1990 | Japan | 62/78 |
| 0275277 | 11/1990 | Japan | 62/78 |
| 3095379 | 4/1991 | Japan | 62/78 |
| 3113260 | 5/1991 | Japan | 62/276 |
| 4013077 | 1/1992 | Japan | 62/275 |

*Primary Examiner*—Henry A. Bennet
*Assistant Examiner*—Christopher R. Kilner
*Attorney, Agent, or Firm*—Burns, Doane, Swecker & Mathis

[57] ABSTRACT

A refrigerator has freezing and cooling compartments, and a cooling device disposed in a space between those compartments. The cooling device includes a refrigerant-conducting pipe arrangement. Attached to that pipe arrangement is a deodorizer comprised of an odor adsorbing element and a heater for heating the odor adsorbing element. The deodorizer is suspended from pipe sections of the pipe arrangement so as to extend transversely relative to a direction of air flow through the cooling device. The cooling device includes a defrosting heater actuated simultaneously with the deodorizer heater so that both heaters perform a defrosting function.

4 Claims, 5 Drawing Sheets

FIG. 2(A)
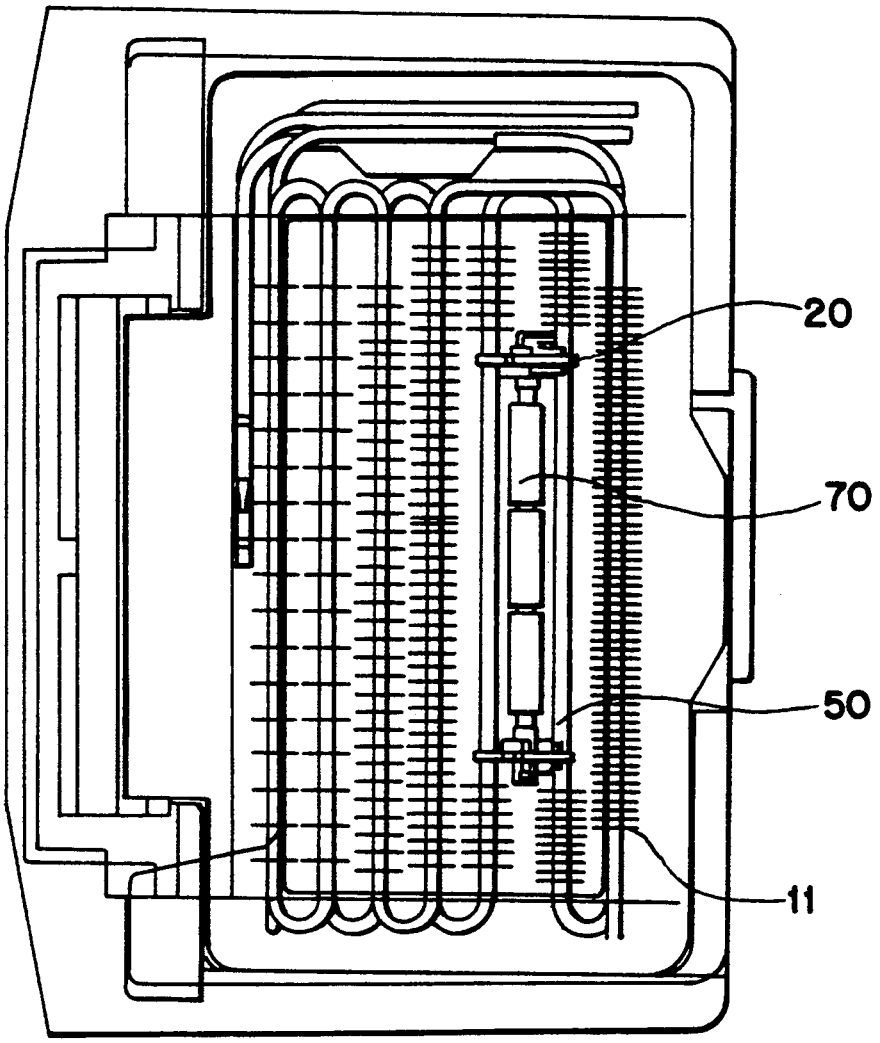
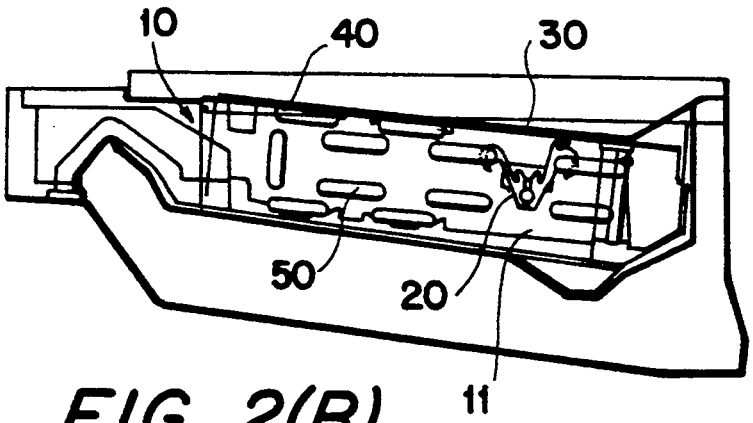
FIG. 2(B)

MOUNTING ARRANGEMENT FOR A REFRIGERATOR DEODORIZER

BACKGROUND OF THE INVENTION

This invention relates to a device for installing a refrigerator deodorizer mounted on an evaporator located in an intermediate compartment between the freezing compartment and the cooling compartment of a refrigerator, where the intermediate compartment is the place where air circulated throughout the interior of the refrigerator is concentrated.

A refrigerator used for storing various kinds of fresh food which are susceptible to being easily spoiled is generally divided into freezing and cooling compartments in order to preserve foods at two different temperatures, which is achieved by the following method: air circulated by a blower fan in the refrigerator passes through an evaporator which is comprised of a great number of refrigerant pipes and cooling fins so as to chill the air; the chilled air is then supplied to the freezing and the cooling compartments. However, unpleasant odors emitted by various kinds of food stored in the compartments are inevitably circulated along with the air throughout the interior of the refrigerator, so that the odors impair the freshness of other foods, which is an undesirable effect arising from the use of the refrigerator.

As shown in FIG. 5, a conventional art has been disclosed by U.S. Pat. No. 4,948,567 in which a deodorizer comprises a deodorizing element 3 which adsorbs odor components contained in the air. That element is placed under a vertical type evaporator 2 mounted on the backside of the freezing compartment, a heater 4 is provided for decomposing the adsorbed odor components by means of heating the deodorizing element 3, and a cover 5 protects the above-listed parts from water generated on the surface of the evaporator 2 by the defrosting cycle.

In the conventional deodorizer, the deodorizing element 3 adsorbs the odor components contained in the air circulated throughout the interior of the refrigerator by a blower fan 1, and then the heater 4, which is operated at constant time intervals, decomposes the adsorbed odor components with heat, and therefore the odor components are thereby removed from the deodorizer.

But, the conventional deodorizer has disadvantages in that it requires a separate space for its installation in a refrigerator and also an additional space for protecting the adjacent surfaces from the heat generated by the heater 4. Furthermore, the deodorizing effect of the deodorizer is not efficient because the air passage where the air from the freezing compartment and the cooling compartment is blended into one stream is relatively large so that a large amount of the circulating odor components are not adsorbed by the deodorizing element.

When the conventional deodorizer is installed in a refrigerator in which a horizontal type evaporator is located in the intermediate compartment between the freezing compartment and the cooling compartment, the aforementioned disadvantage exists due to the requirement of a separate space for the installation in the refrigerator and an additional space for protecting the adjacent surfaces from heat generated by the heater.

An ozone deodorizer is another method used for removing the odors in a refrigerator. But, that method has disadvantages in that additional electric power is necessary and excessive noise is generated by the fan in the ozone deodorizer.

SUMMARY OF THE INVENTION

It is an object of this invention to provide a deodorizer which is installed in the region where air circulating throughout the interior of a refrigerator is centralized and thus odors generated by various kinds of food can be effectively adsorbed.

It is another object of this invention to provide a deodorizer which is mounted on the inside of a horizontal type evaporator located in the intermediate compartment between the freezing and the cooling compartments in order that a separate installation space is not required.

It is another object of this invention to provide a deodorizer in which a heater decomposes the odor components adsorbed by an adsorbent and also eliminates in a short time frost which forms on the surface of the evaporator in combination with a heater for defrosting.

A deodorizer according to this invention is mounted on the inside of a horizontal type evaporator located in an intermediate compartment between a freezing compartment and a cooling compartment.

The evaporator consists of many groups arranged in the direction of the air flow. Each group is comprised of refrigerant pipes forming several layers and a large number of vertical cooling fins which are densely arranged at regular intervals on the refrigerant pipes and connect each group in a body.

Therefore, air circulated throughout the interior of the refrigerator by a blower fan is cooled when it passes through the space between refrigerant pipes and the cooling fins.

This deodorizer is positioned in the space formed by removing a specific number of cooling fins in the rear groups. Accordingly, this deodorizer is also placed in a vertical position parallel to the refrigerant pipes in order to effectively perform the deodorizing function.

This invention comprises a cooling means which is installed in the intermediate compartment between the freezing compartment and the cooling compartment in order to cool air which is circulated throughout the interior of the refrigerator, a deodorizing means including an adsorbing element for adsorbing odor components contained in the air and a heater for heat-decomposing the adsorbed odor components during the defrosting cycle and a cover to protect the adsorbing element and the heater from the water adhering thereon and a pair of securing projections which are disposed in both ends of the cover for receiving and securing the heater, and a securing means for securing the deodorizing means to the cooling means so as to be easily disassembled.

The deodorizing means is secured by means of a pair of securing means in the form of hangers. Each hanger, which is formed in a "V" shape, comprises a pair of "U" shaped hooks formed in the top portions of the left and right arms facing each other in order to be inserted onto a pair of parallel pipes from which the cooling fins have been removed so as to create an open space, a rounded securing slot the top portion of which is opened and which is located at the base of the "V" form in order to receive and secure the securing projection of the deodorizing means, a pair of securing tabs which extend upward from the opened top portion in the securing slot so as to elastically separate from each other when the securing projection is inserted into or withdrawn from the securing slot, and a pair of stabilizing blocks which are disposed in the lower part of the left and right arms formed at an equal distance from each other.

In addition, a second semicircle shaped hook is formed at the upper end of one of the two arms in order to hold a cable used for supplying electric power to the heater.

A pair of the securing hangers configured as above are attached to the evaporator in a manner so that a pair of the hooks of each hanger are attached to a pair of refrigerant pipes parallel to each other in order to support the deodorizing means.

A lengthy stabilizing ridge and a stabilizing tab are formed on the top and bottom respectively of the securing projection, and the former is fitted between the securing tabs and the latter is fitted between a pair of stabilizing blocks, so that the deodorizing means is surely held in the securing means.

The deodorizer which is mounted on the inside of the evaporator as described above removes odor components from the refrigerator by repeatedly performing the following process: the adsorbing element adsorbs odor components contained in the cool air which is circulated throughout the interior of the refrigerator by the blower fan, and then the heater operating at a regular time intervals decomposes the adsorbed odor components into odorless components.

Therefore, the deodorizer according to this invention is able to rapidly adsorb a greater portion of the odor components and it doesn't require an additional installation space because it is mounted on the inside of the evaporator located in the intermediate wall where the air, which is circulated throughout the interior of the refrigerator, is concentrated. Further, there is the effect that the defrosting action for the evaporator can be accomplished in a short time by the interaction of the heater used for decomposing the odor components and the heater used for defrosting.

In addition, the deodorizer can be used indefinitely without being replaced because the adsorbing function of the deodorizer can be periodically revived due to the decomposing work of the heater.

BRIEF DESCRIPTION OF THE DRAWINGS

An embodiment of the invention will now be described by way of example and with reference to the accompanying drawings, in which:

FIG. 2A is a plan view illustrating how this invention is installed in the inside of the evaporator;

FIG. 2B is a side view of FIG. 2A;

DETAILED DESCRIPTION OF THE PREFERRED EMBODIMENT

Figure 1:
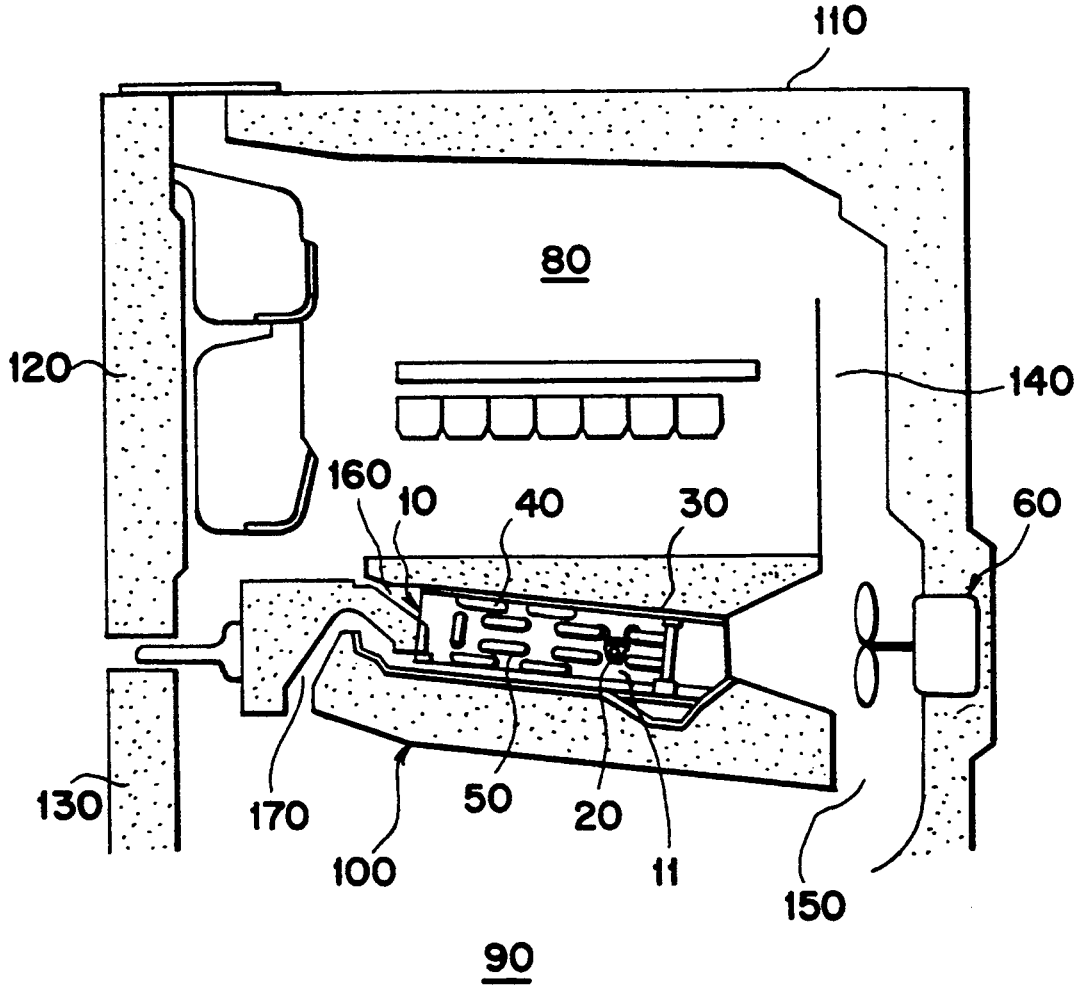
FIG. 1 is a fragmentary cross-sectional view of a refrigerator showing the place where this invention is mounted.

As shown in FIG. 1, the body 110 of a refrigerator is divided into an upper freezing compartment and a lower cooling compartment, and an intermediate compartment 100 is positioned therebetween.

There are doors 120 and 130 at the front of the freezing compartment 80 and the cooling compartment 90 respectively.

A horizontal type evaporator 10 is installed in the intermediate compartment 100, and a blower fan 60 is installed facing the evaporator 10 in the rear passage where a duct 140 for the freezing compartment 80 and a duct 150 for the cooling compartment 90 join together. Thus, a portion of the air circulated throughout the interior of the refrigerator by the blower fan 60 is directed into the freezing compartment 80 after being circulated through the air outlet 160 of the freezing compartment 80 and then the evaporator 10. The residual air is directed into the cooling compartment 90 after being circulated through the air outlet 170 of the cooling compartment 90 and then the evaporator 10.

FIG. 2 illustrates the horizontal type evaporator 10 on which a deodorizer 70 according to this invention is mounted. As shown in the figure, the deodorizer 70 is installed in a vertical position in the space formed by removing the rear cooling fins 11 in the evaporator 10.

Figure 3:
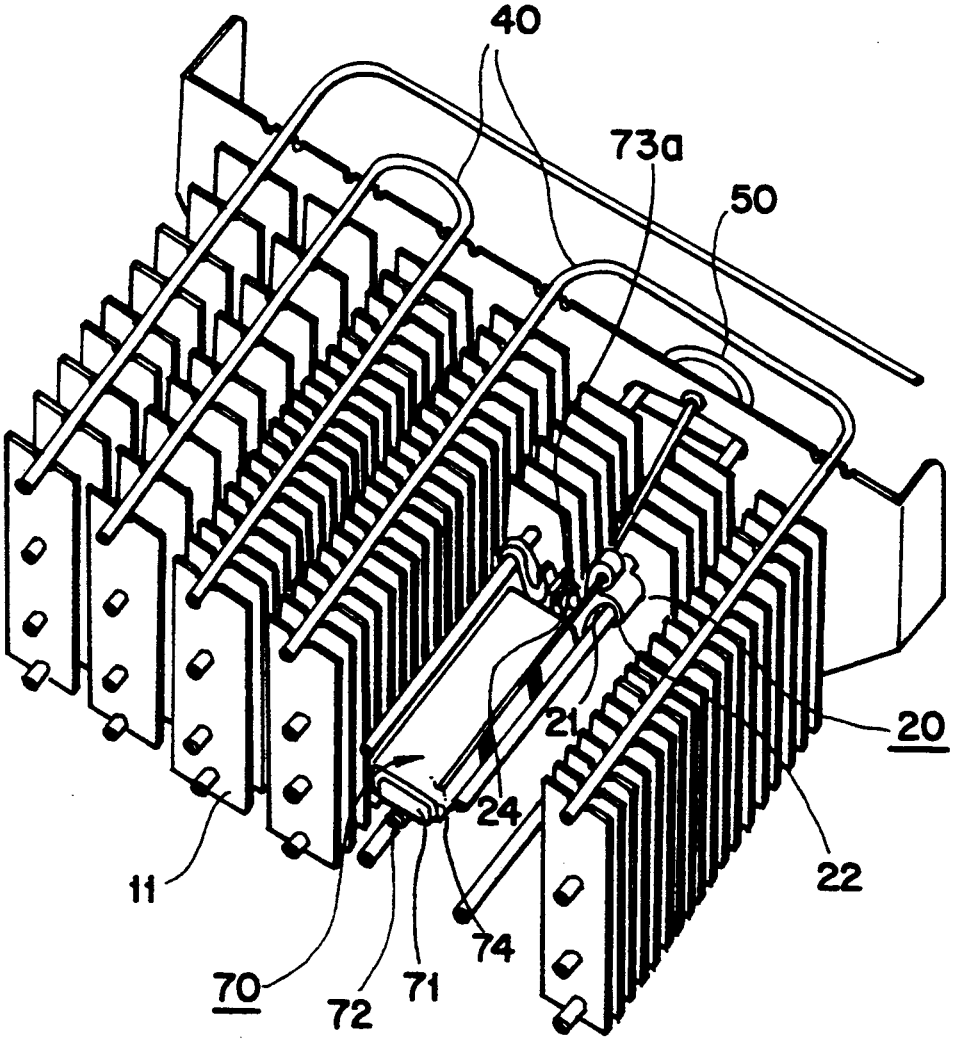
FIG. 3 is a perspective side view, with parts broken away and in section, illustrating how this invention is installed in a space formed by removing a part of the cooling fins in the evaporator.

FIG. 3 illustrates in detail the appearance of the evaporator 10 with the deodorizer 70 located therein. As shown in the figure, refrigerant pipes 50 are formed longitudinally in a number of groups, and each group forms a number of vertically spaced pipe layers.

The cooling fins 11 are densely attached to each group of the refrigerant pipes 50 in a manner that a number of the pipe layers are integrally connected by the cooling fins 11. This deodorizer 70 is installed in the space formed by removing the rear cooling fins 11 of the evaporator 10 configured as described above.

Accordingly, the air introduced into the intermediate compartment 100 passes through the refrigerant pipes 50 and the cooling fins 11 and the deodorizer 70, and as a result it is changed into fresh air. A heater 40 for removing frost is installed on the cooling fins 11.

Figure 4:
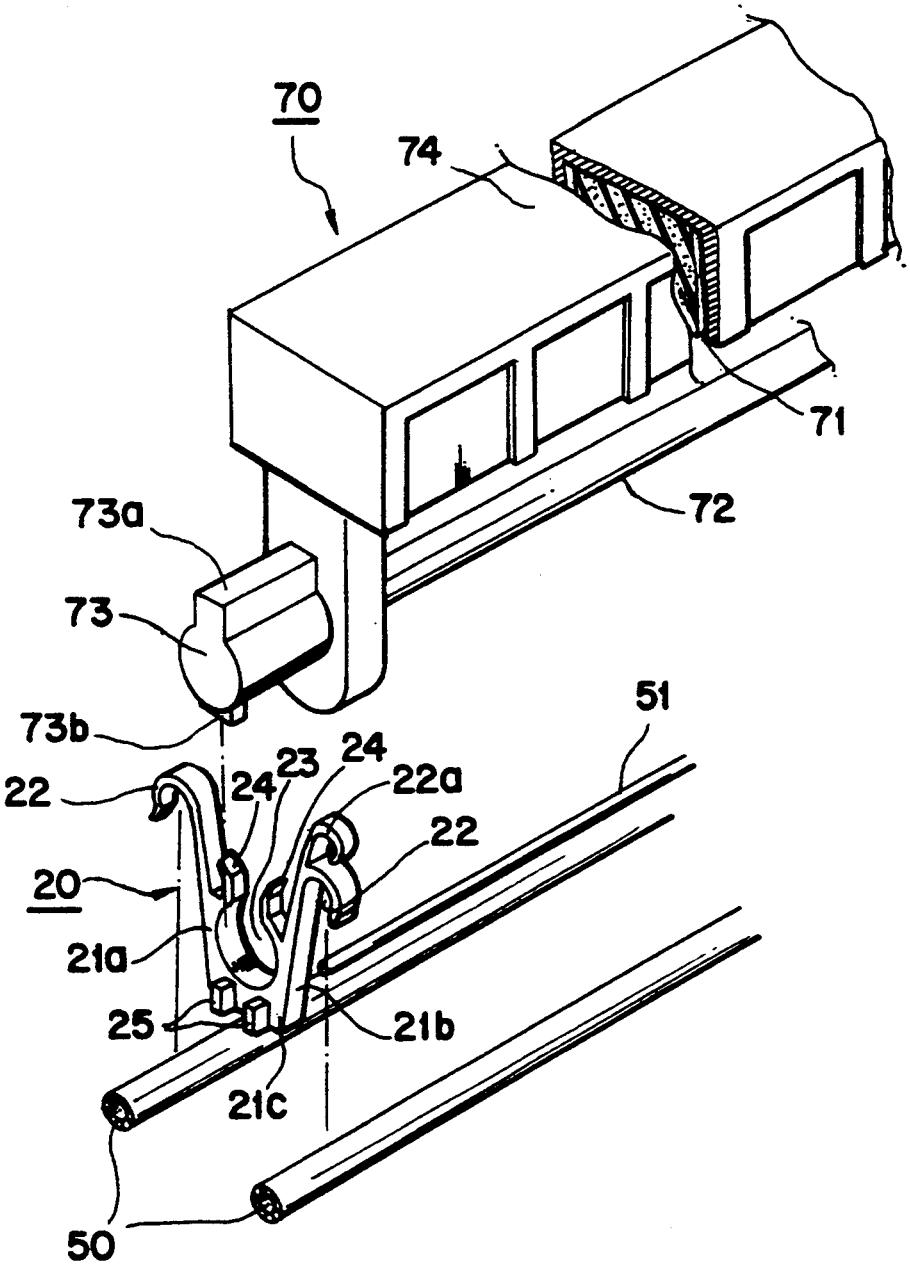
FIG. 4 is an exploded perspective view illustrating the method of installing this invention.
Figure 5:
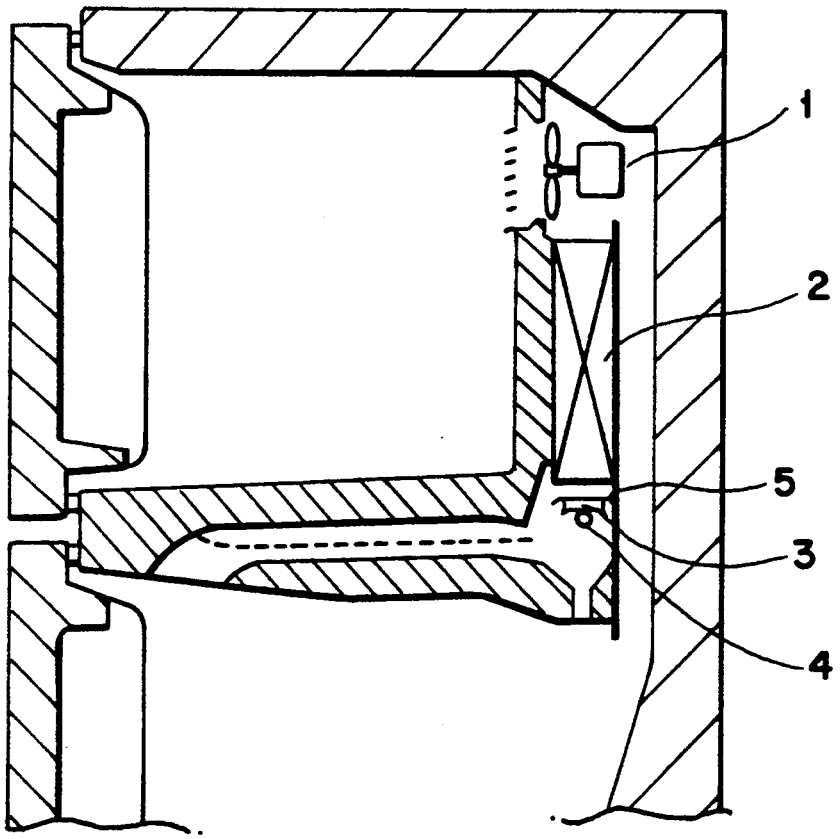
FIG. 5 (PRIOR ART)
FIG. 5 is a fragmentary cross-sectional view of a refrigerator showing the place where a conventional deodorizer is mounted.

FIG. 4 is an exploded perspective view of this invention.

This invention largely comprises the evaporator 10, the deodorizer 70, and a securing means in the form of a pair of hangers 20 for attaching the deodorizer 70 to the evaporator 10.

The deodorizer 70 comprises an adsorbing element 71, a heater 72 positioned under the adsorbing element 71, a cover 74 enclosing the adsorbing element 71, and a pair of securing projections 73 attached to both ends of the cover 74 for securing the heater 72.

The cover 74, which prevents water generated by the defrosting cycle from sticking to the adsorbing element 71 and the heater 72, encloses the adsorbing element 71 leaving some space therebetween so that the adsorbing element 71 is able to effectively adsorb odor components contained in air. Each securing projection 73 has a lengthy stabilizing ridge **73*a* and a stabilizing tab 73*b* which stabilize the deodorizer 70 in a securing slot 23 in each securing hanger 20. Each hanger 20** is configured as follows:

The interval between the left and right arms **21*a* and 21*b* increases as they extend from the base 21*c*, and a pair of "U" shaped hooks 22 are formed at the upper ends of the arms 21***a* and 21*b* respectively.

A round shaped securing slot 23 the top of which is opened, is disposed between the left and right arms 21*a* and 21*b* which extend upwards, and a pair of securing tabs 24 the lower parts of which are parallel to each other and the upper parts of which angle away from each other, are formed to extend from the top of the securing slot 23.

Further, in the base 21*c* a pair of stabilizing blocks 25 are formed at a constant interval, and a semicircle shaped second hook 22*a* is formed to extend upward on the right side of the first hooks 22.

The securing hangers 20 configured as described above are attached to the evaporator 10 when a pair of the first hooks 22 are attached to a pair of the refrigerant pipes 50 which are parallel to each other.

On the other hand, the deodorizer 70 is attached to the securing means when a pair of the securing projections 73 are inserted into the securing slot 23 of the securing means 20. At this time, the stabilizing ridge 73a and the stabilizing tab 73*b* positioned at the top and bottom of the securing projection 73, are tightly engaged with the parallel parts of the securing tabs 24 and the stabilizing blocks 25 respectively of the base 21*c*, so that the deodorizer 70 doesn't move further in the securing hangers 20 after the deodorizer 70 is secured.

The second hook 22*a* holds a cable 51 used for supplying electric power to the heater 72.

In addition, as shown in FIG. 2B, a heat-reflecting plate 30 is mounted on the top of the intermediate compartment 100 to uniformly radiate to the evaporator 10 the heat generated by the heaters 40 and 72.

The adsorbing element 71 is made by spraying a metal catalyst such as platinum or vanadium on the surface of a porous substance such as diatomaceous earth etc.

The cover 74, which is used to cover the adsorbing element 71 and the heater 72, is made of a heatproof and waterproof material such as aluminum, and it prevents water generated by the defrosting cycle from sticking to the adsorbing element 71 or to the heater 72.

The deodorizing process by the deodorizer 70 mounted on the evaporator 10 as described above will now be described in detail.

When a refrigerator with this deodorizer 70 begins to operate, by means of the blower fan 60 the air in the freezing compartment 80 is directed into the intermediate compartment 100 through the air outlet 160 for the freezing compartment 80. At the same time, the air in the cooling compartment 90 is also directed into the intermediate compartment 100 through the air outlet 170 for the cooling compartment 90, and thereby the air is combined in the intermediate compartment 100.

The combined air is cooled to a low temperature while passing through the evaporator 10, and then a portion of the air is directed to the freezing compartment 80 through the duct 140 for the freezing compartment 80 and the residual air is directed to the cooling compartment 90 through the duct 150 for the cooling compartment 90.

While passing through the evaporator 10, the combined air comes into contact with the adsorbing element 71 of the deodorizer 70 placed in the inside of the evaporator 10. As a result, odor components contained in the air are adsorbed by the surface of the adsorbing element 71, thus only fresh air is discharged into the freezing compartment 80 and the cooling compartment 90.

The deodorizer 70, according to this invention, is able to more effectively adsorb the odor components in a refrigerator because the greater part of the air is introduced into the evaporator 10 through a small sectional area formed in the inlet of the intermediate compartment 100 because the intermediate compartment 100 is shallow.

As the refrigerator is continuously operated, the moisture contained in the air condenses on the surface of the evaporator 10 and frost is formed. Where the frost accumulates to cover the entire surface of the evaporator 10, the evaporator 10 does not sufficiently heat-exchange the air, and consequently the cooling efficiency is reduced.

In order to remove the frost from the surface of the evaporator 10, when the operating time of the compressor(not shown) reaches a fixed value, the operation of the compressor and the blower fan 60 is stopped, and electric power is supplied to the defrosting heater 40 located in the upper and lower parts of the evaporator 10 in order to heat the surface of the evaporator 10 and to the heater 72 for decomposing the adsorbed odor components.

At the same time, the heat generated by the heater 72 is transmitted to the adsorbing element 71 so that the odor components adsorbed by the adsorbing element 71 is oxidized and decomposed.

Further, the adsorbing function of the deodorizer 70 is revived because the odor components in the adsorbing element 71 are removed for decomposing by the heater 72.

After the defrosting cycle on the surface of the evaporator 10 has been completed, the refrigerator returns to the normal operating condition wherein the power supply to the heaters 40 and 72 is switched off and the blower fan 60 is operated again.

What is claimed is:

1. A refrigerator comprising:

a freezing compartment;

a cooling compartment disposed in vertically spaced relationship to said freezing compartment to form a space therebetween;

a cooling system disposed in said space and defining air inlet and outlet ends, said cooling system including a refrigerant-circulating pipe arrangement having pipe sections extending transversely relative to a direction of air travel through said cooling system, and a defrosting heater;

a circulating mechanism for circulating air from said freezing and cooling compartments through said cooling system;

a deodorizer unit arranged intermediate said inlet and outlet ends of said cooling system, said deodorizer unit including an odor adsorbing element, a heater for heating said odor adsorbing element to remove odors therefrom and a longitudinally extending projection at each end of said deodorizer unit, said heater of said deodorizer unit and said defrosting heater being simultaneously operable so that both of said heaters perform a defrosting function; and a securing mechanism including a pair of hangers for suspending opposite ends of said deodorizer unit to said pipe arrangement such that said deodorizer unit extends transversely to said direction of air travel through said cooling system, each hanger including a pair of arms having hook-shaped upper portions for hooking onto respective pipe sections, and an upwardly open slot formed between said arms of each hanger for receiving a respective one of said projections.

2. A refrigerator according to claim 1, wherein said arms of each hanger diverge upwardly.

3. A refrigerator according to claim 1, wherein said slot is circular, and each projection and its respective hanger present mutually engageable surfaces for preventing rotation of said deodorizer unit about an axis defined by said projections.

4. A refrigerator according to claim 1 including a heat reflector plate disposed over both said defrosting heater and said heater of said deodorizer unit.

* * * * *